US012721392B2

(12) United States Patent
Kim

(10) Patent No.: US 12,721,392 B2
(45) Date of Patent: Sep. 1, 2026

(54) WIG MANUFACTURING APPARATUS AND METHOD, AND WIG MANUFACTURED USING THE SAME

(71) Applicant: HAIRPIA TECHNOLOGY Co.,Ltd., Jeonju-si (KR)

(72) Inventor: Ho Yon Kim, Seoul (KR)

(73) Assignee: HAIRPIA TECHNOLOGY Co., Ltd., Jeonju-si (KR)

( * ) Notice: Subject to any disclaimer, the term of this patent is extended or adjusted under 35 U.S.C. 154(b) by 322 days.

(21) Appl. No.: 18/376,989

(22) Filed: Oct. 5, 2023

(65) Prior Publication Data

US 2025/0049158 A1 Feb. 13, 2025

(30) Foreign Application Priority Data

Aug. 10, 2023 (KR) ..... 10-2023-0104592

(51) Int. Cl.
*A41G 3/00* (2006.01)
*D05C 15/02* (2006.01)

(52) U.S. Cl.
CPC ..... *A41G 3/0075* (2013.01); *A41G 3/0077* (2026.05); *D05C 15/02* (2013.01)

(58) Field of Classification Search
None
See application file for complete search history.

(56) References Cited

U.S. PATENT DOCUMENTS 2,233,100 A * 2/1941 Jevnikar ..... A41G 3/00 132/53
2022/0030998 A1* 2/2022 Cheong ..... D05C 17/023
2023/0301384 A1* 9/2023 Iimura ..... G06T 7/0004

FOREIGN PATENT DOCUMENTS

CN 111743253 A 10/2020
CN 220034888 U * 11/2023
KR 1020060040154 A 5/2006
KR 1020210121073 A 10/2021
WO WO-2023182074 A1 * 9/2023 ..... A41G 3/00
WO WO-2023182076 A1 * 9/2023 ..... A41G 3/00

* cited by examiner

*Primary Examiner* — Tatiana L Nobrega
(74) *Attorney, Agent, or Firm* — Dinsmore & Shohl LLP; Yongsok Choi, Esq.

(57) ABSTRACT

Provided is a wig manufacturing method. The wig manufacturing method includes dividing a planting net, into which a wig fiber is planted, into a plurality of areas to be designed in a certain pattern, by using a computer device, inputting a planting process using a plurality of needles of a wig manufacturing apparatus according to a pattern shape of each divided net, manufacturing, by the wig manufacturing apparatus, a divided fabric by planting the wig fiber into each divided net according to the input planting process, and cutting and sewing each manufactured divided fabric.

4 Claims, 12 Drawing Sheets

WIG MANUFACTURING APPARATUS AND METHOD, AND WIG MANUFACTURED USING THE SAME

CROSS-REFERENCE TO RELATED APPLICATION

This application is based on and claims priority under 35 U.S.C. § 119 to Korean Patent Application No. 10-2023-0104592, filed on Aug. 10, 2023, in the Korean Intellectual Property Office, the disclosure of which is incorporated by reference herein in its entirety.

BACKGROUND

1. Field

The disclosure relates to a wig manufacturing apparatus and method, and a wig manufactured using the same. More particularly, the disclosure relates to a wig manufacturing apparatus and method for manufacturing a divided fabric by dividing one planting net into a plurality of areas having a certain pattern and planting wig fibers according to the pattern of the divided areas, and a wig manufactured using the wig manufacturing apparatus and method.

2. Description of the Related Art

Luxury wigs have traditionally been manufactured by hand. A wig is manufactured by knotting each strand of human hair or artificial fiber to a net (also referred to as a cap, a base, or a wig pattern). As a conventional method of manufacturing a luxury wig by hand requires a tremendous amount of labor, methods of manufacturing wigs have been constantly researched and developed from various perspectives.

In a conventional method of manufacturing a luxury wig, a wig fabric is manufactured by manufacturing a full cap of a standardized style by using a net and then manually knotting the fibers of the entire cap, or a wig fabric is manufactured by manually knotting some fibers and then attaching the fibers through a sewing machine.

RELATED LITERATURES

Patent Literature (Patent Literature 0001) Patent Application Publication No. 10-2006-0040154A (2006.05.10)

SUMMARY

Provided is a wig manufacturing apparatus and method suitable for mass production and capable of providing high productivity through planting of wig fibers according to a pattern, by dividing a planting net into a plurality of areas to be designed in a certain pattern, and then planting all or some of wig fibers according to the pattern of each divided net area, and a wig using the wig manufacturing apparatus and method.

Provided is a wig manufacturing apparatus and method capable of automatically manufacturing wig fabrics divided in various ways according to a user's head, and a wig manufactured using the wig manufacturing apparatus and method.

Provided is a wig manufacturing apparatus and method capable of adjusting tension when a planting net is supplied, and a wig using the wig manufacturing apparatus and method.

Objectives of the disclosure are not limited to the above-mentioned objectives, and other objectives not mentioned herein will be clearly understood by one of ordinary skill in the art from the following description.

According to an aspect of the disclosure, a wig manufacturing method includes dividing a planting net, into which a wig fiber is planted, into a plurality of areas to be designed in a certain pattern, by using a computer device, inputting a planting process using a plurality of needles of a wig manufacturing apparatus according to a pattern shape of each divided net, manufacturing, by the wig manufacturing apparatus, a divided fabric by planting the wig fiber into each divided net according to the input planting process, and cutting and sewing each manufactured divided fabric.

The manufacturing of the divided fabric may include adjusting tension of the planting net supplied to the wig manufacturing apparatus to be maintained at a pre-determined value according to a type of the planting net.

The manufacturing of the divided fabric may include selecting, by a user, planting patterns corresponding to the plurality of divided areas, through a user interface unit.

The divided planting net may include a front portion having a half-moon shape, a central portion having a rectangular shape and extending adjacent to a center of the front portion, a left portion having a half-fan shape and adjacent to a lower left side of the front portion and a left side of the central portion, and a right portion having a half-fan shape and adjacent to a lower right side of the front portion and a right side of the central portion.

A shape obtained by sewing the front portion, the central portion, the left portion, and the right portion may be a hemispherical shape, and the left portion and the right portion may be symmetrical to each other.

According to another aspect of the disclosure, a wig manufacturing apparatus includes a fiber storage stand configured to accommodate a wig fiber, a net supply device configured to supply a planting net into which the wig fiber is planted, a needle device configured to receive the wig fiber from the fiber storage stand and tie the wig fiber to the planting net, and a controller configured to operate the needle device to manufacture a wig fabric according to a shape of a pattern input to the planting net.

The controller may include a user interface unit configured to select, by a user, a type of the pattern input to the planting net.

The wig manufacturing apparatus may further include a tension adjusting device configured to maintain tension of the planting net at a pre-determined value according to a type of the planting net.

The tension adjusting device may include an actuator configured to fix one end of the planting net and adjust a distance by which the planting net is linearly moved.

The actuator may include a motor, and tension applied to the planting net may be adjusted by adjusting a rotational speed of the motor.

The controller may include a pattern work unit configured to divide the planting net into a plurality of areas and set an operation of a needle of the needle device to correspond to a certain pattern formed in each divided area.

The controller may include a needle control unit configured to control an operation of a needle to plant the wig fiber into the planting net according to shapes of a plurality of divided patterns.

According to another aspect of the disclosure, a wig is produced by manufacturing a wig fabric by binding wig fibers to a planting net having a certain pattern for each divided area and cutting and sewing the manufactured wig fabric, wherein the wig is designed by dividing the planting net into a front portion having a substantially half-moon shape, a central portion having a rectangular shape and adjacent to a center of the front portion, a left portion having a half-fan shape and adjacent to a lower left side of the front portion and a left side of the central portion, and a right portion having a half-fan shape and adjacent to a lower right side of the front portion and a right side of the central portion, wherein fabrics of the front portion, the central portion, the left portion, and the right portion into which the wig fibers are planted are manufactured by a wig manufacturing apparatus, and wherein the manufactured divided fabrics of the front portion, the central portion, the left portion, and the right portion are sewn, and wherein a structure in which the front portion, the central portion, the left portion, and the right portion are sewn and combined with each other has a substantially hemispherical shape, and the fabrics of the left portion and the right portion are symmetrical to each other.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1:
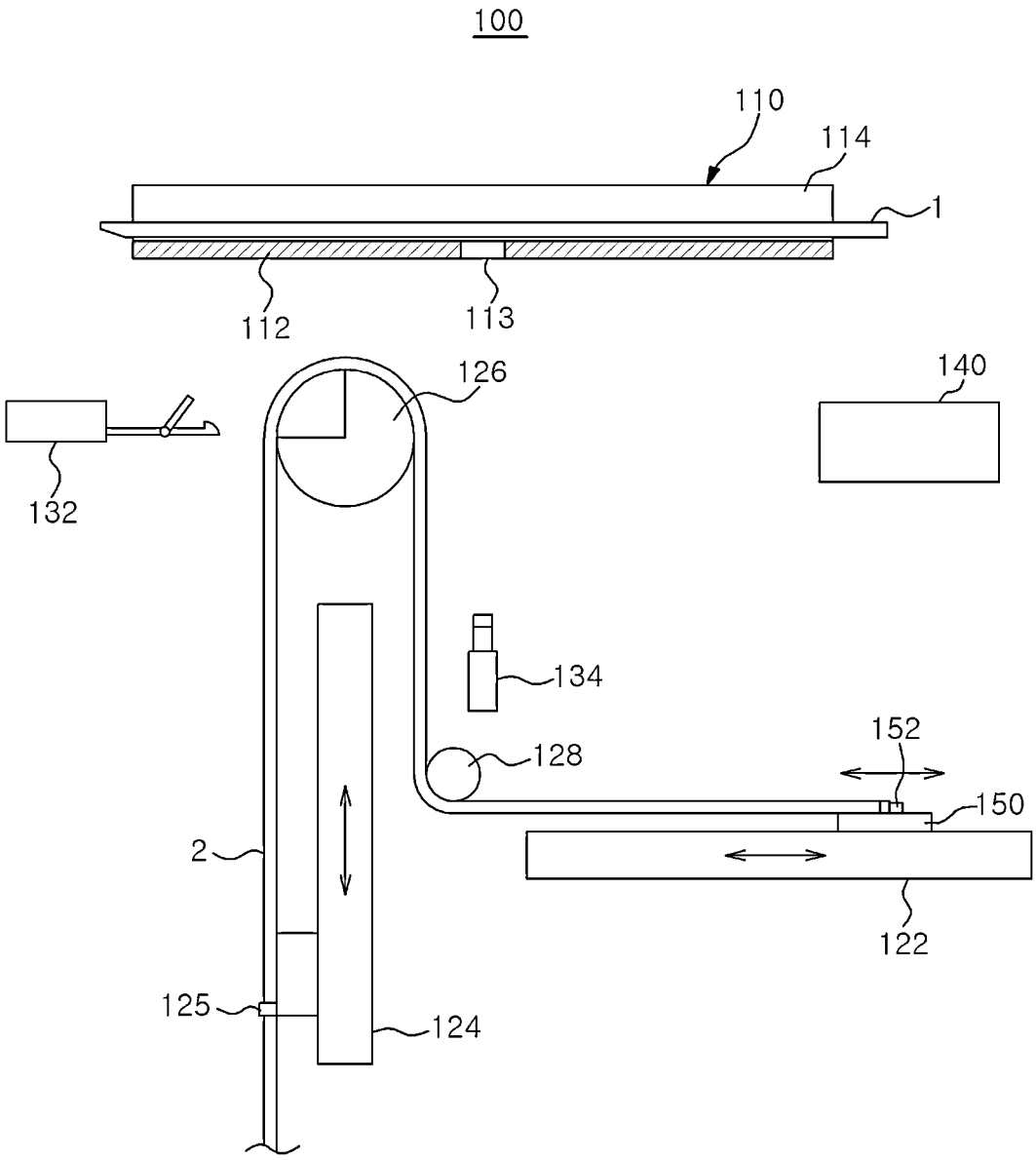
FIG. 1 is a side view illustrating a schematic configuration of a wig manufacturing apparatus, according to an embodiment of the disclosure.

Embodiments of the disclosure will now be described more fully with reference to the accompanying drawings for one of ordinary skill in the art to be able to perform the disclosure without any difficulty. However, the disclosure may be embodied in many different forms and is not limited to the embodiments of the disclosure set forth herein. In addition, portions irrelevant to the description of the disclosure will be omitted in the drawings for clear descriptions of the embodiments of the disclosure.

Also, the terms used herein are for the purpose of describing certain embodiments of the disclosure only and are not intended to be limiting of the disclosure. As used herein, the singular expressions are intended to include plural forms as well, unless the context clearly dictates otherwise.

Further, as used in this specification, the terms "include," "have", and "comprise" may be construed to denote a certain feature, number, step, operation, constituent element, component, or a combination thereof, but may not be construed to exclude the existence or addition of one or more other features, numbers, steps, operations, constituent elements, components, or combinations thereof.

Although components described in the embodiments of the disclosure are independently illustrated in order to show different characteristic functions, such a configuration does not indicate that each component is constructed by separate hardware or one software constituent unit. That is, each component includes individual components that are arranged for convenience of description, in which at least two components may be combined into a single component or a single component may be divided into a plurality of components to perform functions. It is to be noted that embodiments in which some components are integrated into one combined component and/or a component is divided into multiple separate components are included in the scope of the disclosure without departing from the essence of the disclosure.

Also, the following embodiments are provided to more clearly explain the disclosure to one of ordinary skill in the art, and shapes and sizes of elements in the drawings may be exaggerated for clarity.

Hereinafter, preferred embodiments according to the disclosure will be described with reference to the accompanying drawings.

Figure 2:
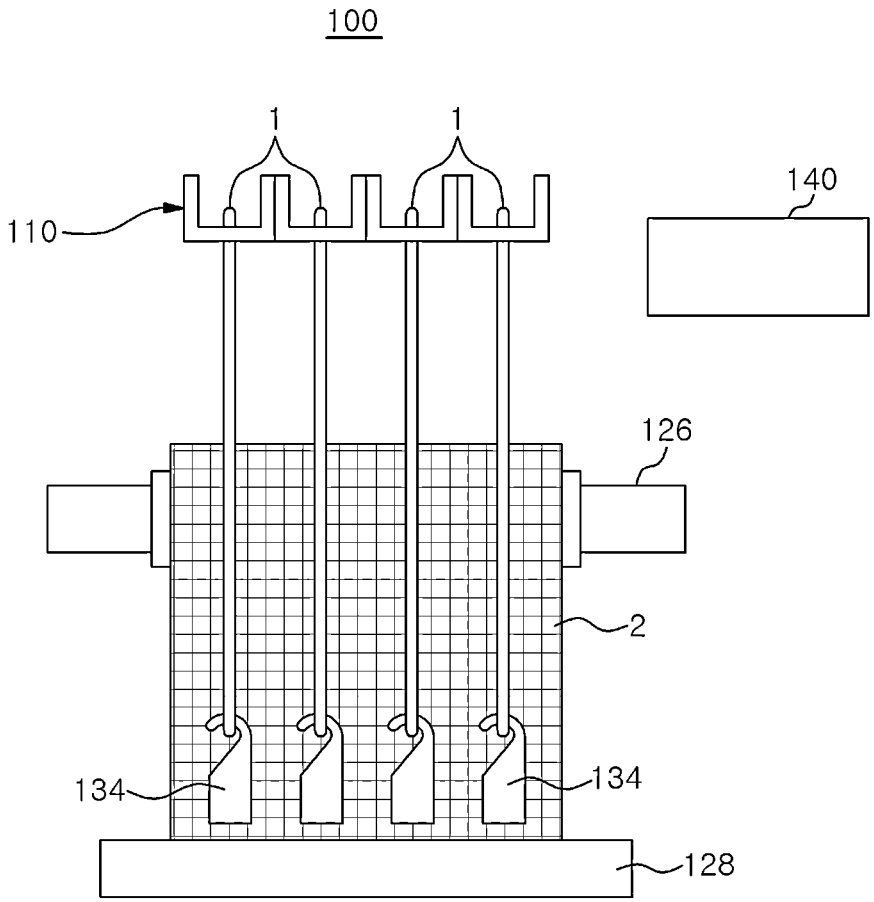
FIG. 2 is a front view illustrating a schematic configuration of a wig manufacturing apparatus, according to an embodiment of the disclosure.
Figure 3:
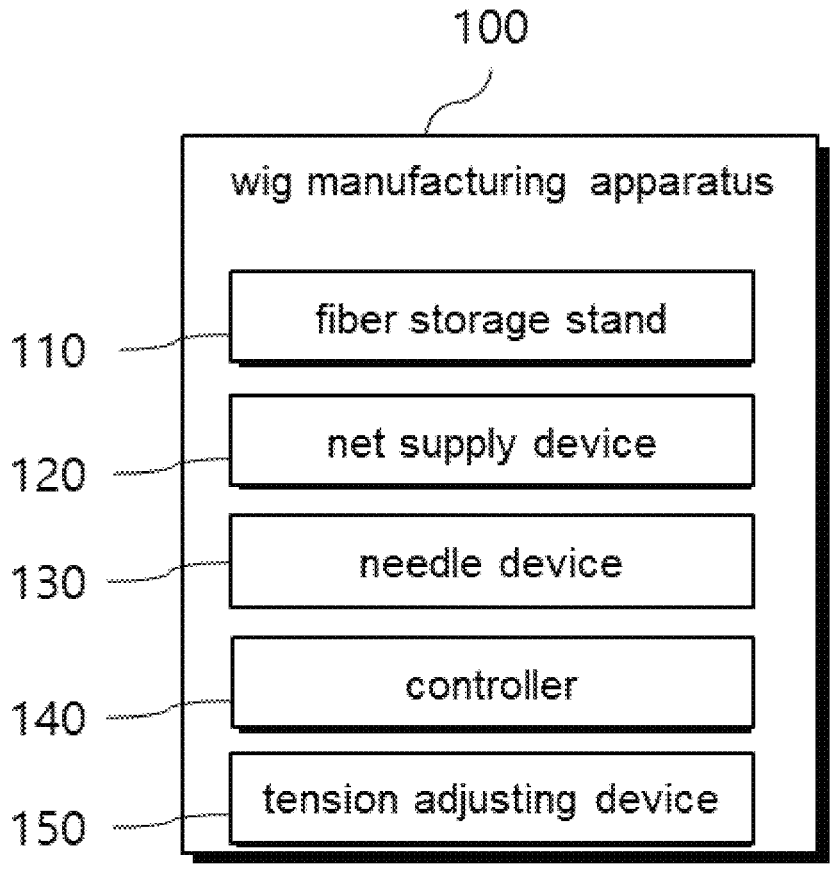
FIG. 3 is a block diagram illustrating a configuration of a wig manufacturing apparatus, according to an embodiment of the disclosure.
Figure 4:
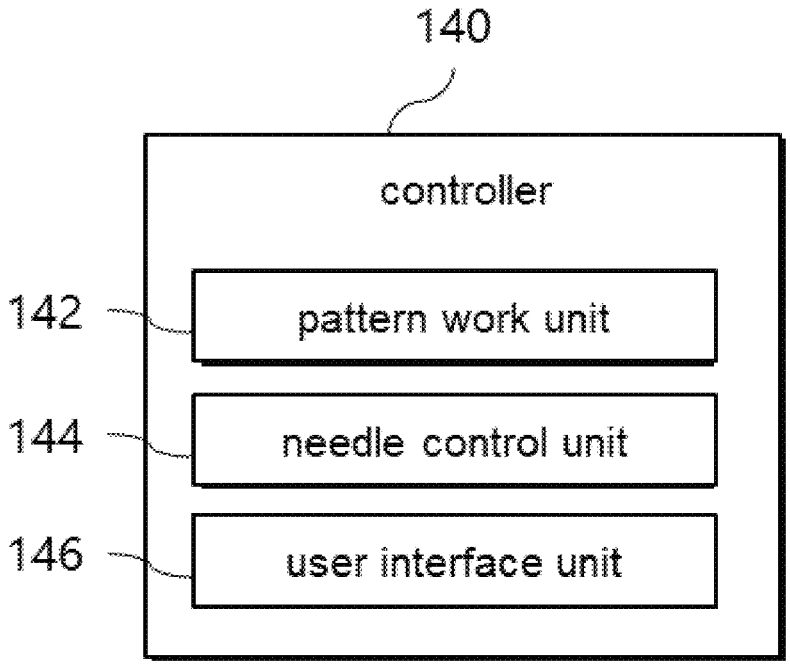
FIG. 4 is a block diagram illustrating a configuration of a controller of a wig manufacturing apparatus, according to an embodiment of the disclosure.
Figure 5:
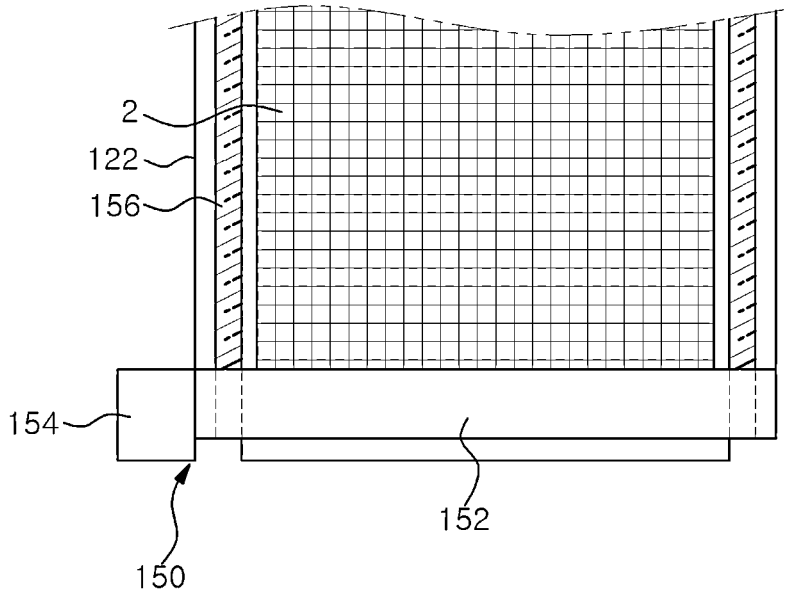
FIG. 5 is a view illustrating a tension adjusting device, according to an embodiment of the disclosure.
Figure 6:
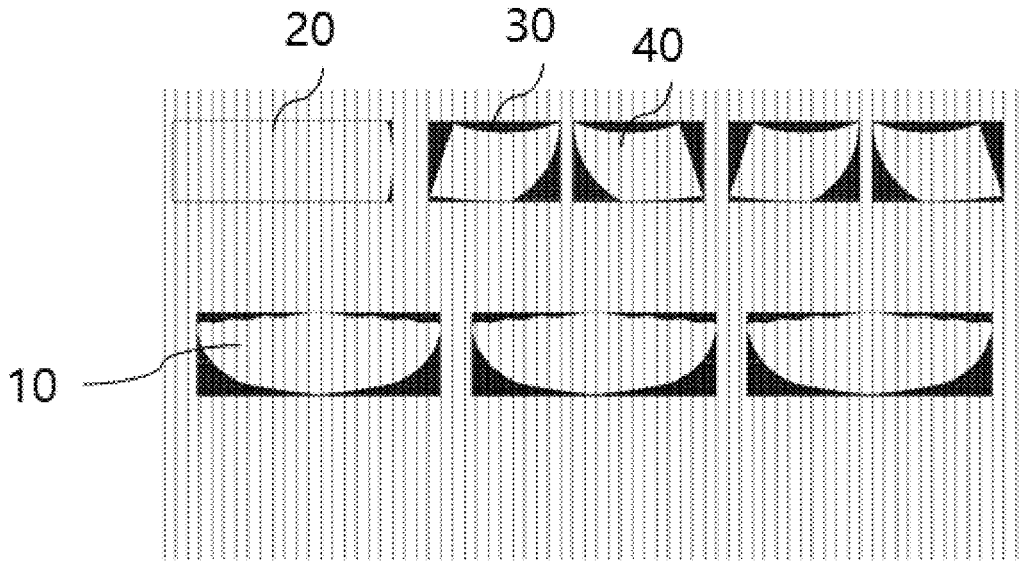
FIG. 6 is a view illustrating an example where an area of a planting net is divided and a pattern work is performed in each area, according to an embodiment of the disclosure.

FIG. 1 is a side view illustrating a schematic configuration of a wig manufacturing apparatus, according to an embodiment of the disclosure. FIG. 2 is a front view illustrating a schematic configuration of a wig manufacturing apparatus, according to an embodiment of the disclosure. FIG. 3 is a block diagram illustrating a configuration of a wig manufacturing apparatus, according to an embodiment of the disclosure. FIG. 4 is a block diagram illustrating a configuration of a controller of a wig manufacturing apparatus, according to an embodiment of the disclosure. FIG. 5 is a view illustrating a tension adjusting device, according to an embodiment of the disclosure. FIG. 6 is a view illustrating an example where a planting net is divided and a pattern work is performed in each area, according to an embodiment of the disclosure.

Referring to FIGS. 1 to 5, a wig manufacturing apparatus 100 according to an embodiment of the disclosure may include a fiber storage stand 110, a net supply device 120, a needle device 130, and a controller 140.

The fiber storage stand 110 is provided to accommodate a wig fiber 1. For example, the fiber storage stand 110 may include a bottom portion 112 having a long flat plate shape and side walls 114 protruding upward from both ends of the bottom portion 112 in a left-right direction, and may have a cylindrical shape in which upper portions of the side walls 114 are open. A plurality of fiber storage stands 110 may be arranged in the left-right direction to accommodate various types of wig fibers 1. The fiber storage stand 110 may be provided at a fixed position, and a hole 113 may be formed in the bottom portion 112 so that the wig fiber 1 is pulled out by a vertical needle 134 that moves up and down.

The net supply device 120 is provided to constantly supply a planting net 2 into which the wig fiber 1 is planted to a position where the needle device 130 may work. The net supply device 120 may include a horizontal transfer unit 122, a vertical transfer unit 124, a main roller unit 126, and a guide roller 128. One end of the planting net 2 may be fixed to the horizontal transfer unit 122 and the other end of the planting net 2 may be fixed to the vertical transfer unit 124, and the planting net 2 may be transferred while a middle portion is supported on the main roller unit 126 and the guide roller 128. The horizontal transfer unit 122 and the vertical transfer unit 124 may transfer the planting net at a constant speed. A speed at which the net supply device 120 transfers the planting net may be set to match a planting speed of the needle device 130.

The needle device 130 is provided to tie the wig fiber 1 to the planting net 2 supplied by the net supply device 120. The needle device 130 includes a plurality of horizontal needles 132 and a plurality of vertical needles 134, and as the planting net 2 is supplied at a pre-determined speed, the needle device 130 may hold and move the wig fiber 1 at a corresponding position and may bind the wig fiber 1 to the planting net 2. Each horizontal needle 132 and each vertical needle 134 may be moved by a needle control unit 144 of the controller 140, and thus, the wig fiber 1 may be bound to the planting net 2 by using a single method, a half-single method, a double method, or a half-double method. Also, one to four wig fibers 1 may be tied according to the number of strands of a binding position.

The controller 140 is provided to operate the horizontal and vertical needles 132 and 134 of the needle device 130 to tie the wig fiber 1 to the planting net 2 according to a shape of a pattern that is input in advance. The controller 140 may include a pattern work unit 142, the needle control unit 144, and a user interface unit 146.

Referring to FIG. 6, the pattern work unit 142 may divide the planting net 2 having a certain size into a plurality of areas and set operations of the horizontal and vertical needles 132 and 134 to correspond to a certain pattern formed in each divided area. The pattern work unit 142 may receive a data file (e.g., a CAD file or an image file) having a divided pattern shape of the planting net 2 and convert the data file into a programmable logic controller (PLC) program. Also, the pattern work unit 142 may set the horizontal needle 132 and the vertical needle 134 to operate according to the divided pattern shape.

The needle control unit 144 may operate the needle device 130 so that the wig fiber 1 is tied to the planting net 2 according to the divided pattern shape corresponding to each of the plurality of divided areas. As the planting net 2 is supplied, the controller 140 may bind the wig fiber 1 to the planting net 2 by moving the horizontal needle 132 and the vertical needle 134 to a position where planting is required for each column of each row of the planting net 2. Although not shown, the horizontal needle 132 and the vertical needle 134 may pull out the wig fiber 1 accommodated in the fiber storage stand 110 and bind the wig fiber 1 to the planting net 2 while being reciprocated by a pneumatic actuator.

The wig manufacturing apparatus 100 according to an embodiment of the disclosure may further include a tension adjusting device 150.

The tension adjusting device 150 may adjust tension of the planting net 2 having both ends fixed to the horizontal transfer unit 122 and the vertical transfer unit 124 of the net supply device 120. An interval of holes and a material of the planting net 2 may vary according to a type of a wig to be manufactured, and an appropriate tension needs to be formed in the planting net 2 in order for the horizontal needle 132 and the vertical needle 134 to smoothly bind the wig fiber 1 to the planting net 2 according to a type of the planting net 2. The tension adjusting device 150 may set an appropriate tension to be applied to the planting net 2 by finely linearly moving the planting net 2, one end of which is fixed, back and forth in a horizontal direction on the horizontal transfer unit 122. In detail, the tension adjusting device 150 may include an actuator capable of fixing one end of the planting net 2 and adjusting a distance by which the planting net 2 is linearly pulled on the horizontal transfer unit 122. For example, the actuator may include a motor. The tension adjusting device 150 may finely adjust tension applied to the planting net 2 by adjusting a rotational speed and the number of rotations of the motor. In detail, the tension adjusting device 150 may include a clamping unit 152 for fixing one end of the planting net 2, a motor 154 connected to the clamping unit 152 and configured to generate power for linearly transporting the clamping unit 152, and a transfer rail 156 for guiding linear movement of the clamping unit 152. That is, the motor 154, the clamping unit 152, and the transfer rail 156 may constitute a linear guide.

Hereinafter, the user interface unit 146 of the controller 140 according to an embodiment of the disclosure will be described.

Figure 7:
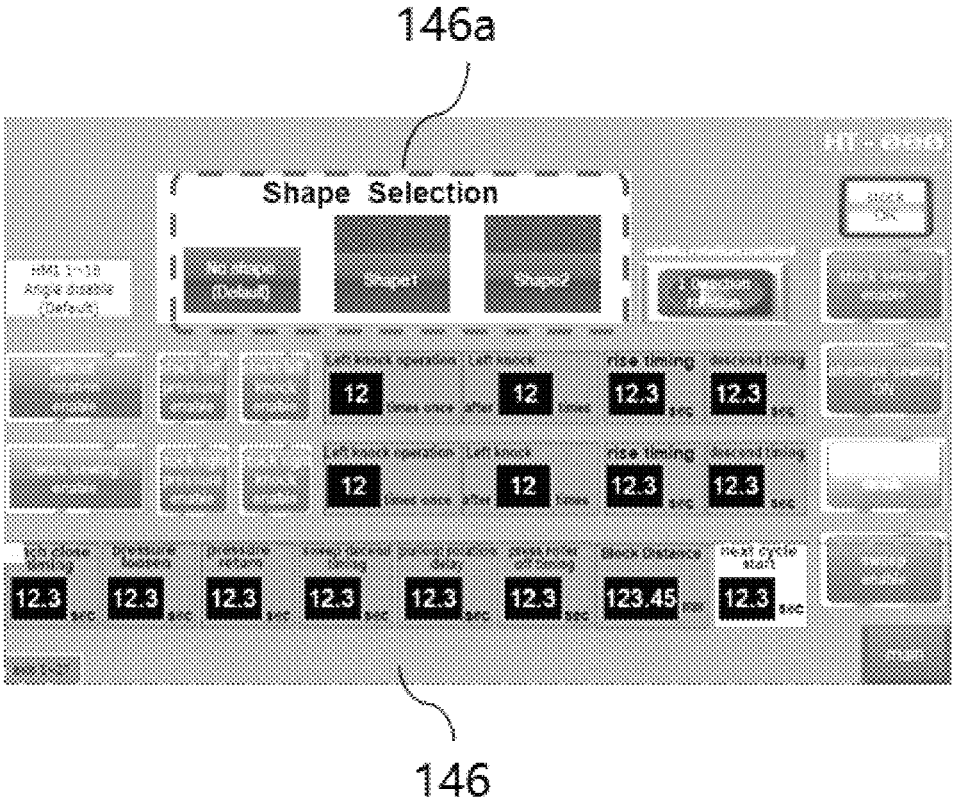
FIG. 7 is a view for describing an example where a pattern is selected by using a user interface unit of a controller, according to an embodiment of the disclosure.
Figure 8:
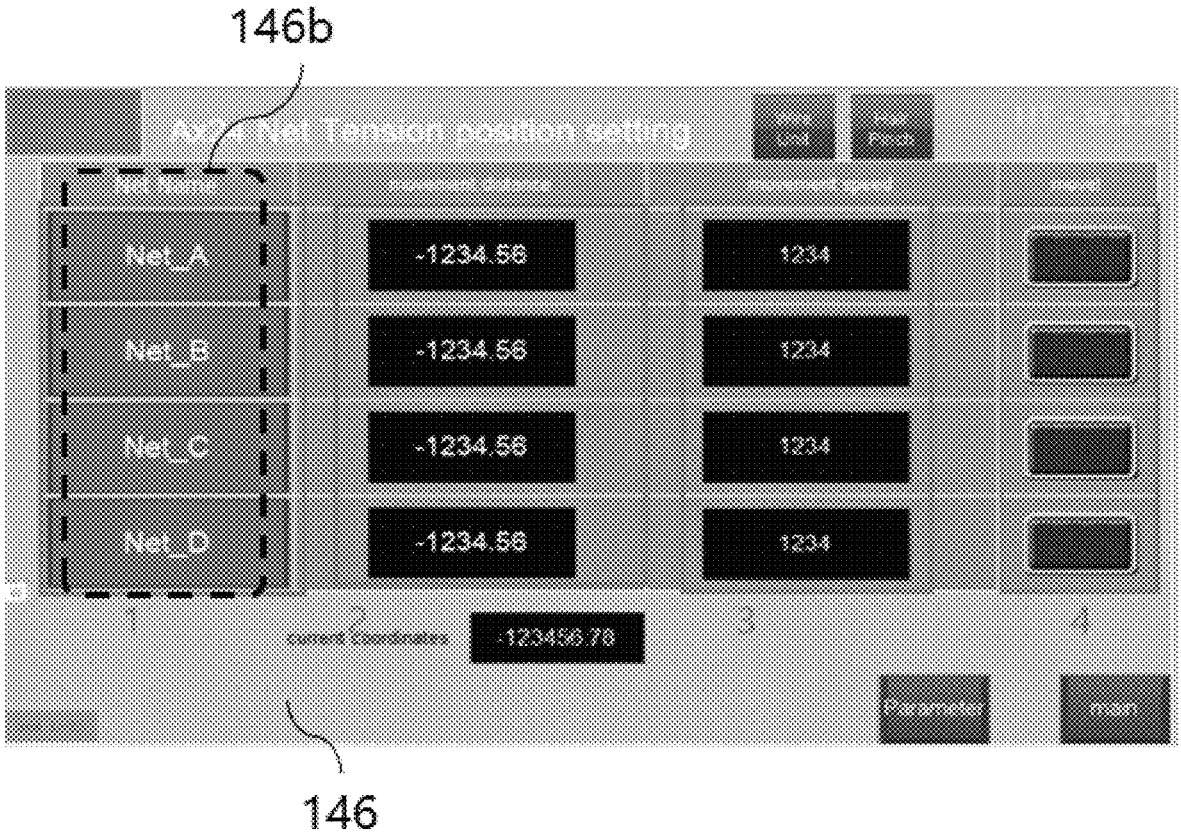
FIG. 8 is a view for describing an example where tension is adjusted by using a user interface unit of a controller, according to an embodiment of the disclosure.

FIG. 7 is a view for describing an example where a pattern is selected by using a user interface unit of a controller, according to an embodiment of the disclosure. FIG. 8 is a view for describing an example where tension is adjusted by using a user interface unit of a controller, according to an embodiment of the disclosure.

Referring to FIGS. 7 and 8, the user interface unit 146 according to an embodiment of the disclosure may include a pattern selecting unit **146*a* for selecting a pattern according to which the wig fiber 1 is to be bound to the planting net 2 and a tension setting unit 146*b* for setting tension applied to the planting net 2 according to a type of the planting net 2. A worker may select a plurality of patterns according to which the wig fiber 1 is to be planted into the planting net 2 through the pattern selecting unit 146*a*. According to the selected plurality of patterns, the controller 140 may appropriately arrange the selected plurality of patterns on the planting net 2 so that the work efficiency of the planting net 2 is maximized. Also, the worker may set an initial position of the tension adjusting device 150 and a speed of the motor so that an appropriate tension is applied according to a type of the planting net 2 through the tension setting unit 146*b*. When the worker selects a desired type of planting net 2 through the tension setting unit 146*b* and clicks on a transfer button, the tension adjusting device 150 may change the initial position of the planting net 2** by operating the motor.

Hereinafter, a wig manufacturing method according to an embodiment of the disclosure will be described.

Figure 9:
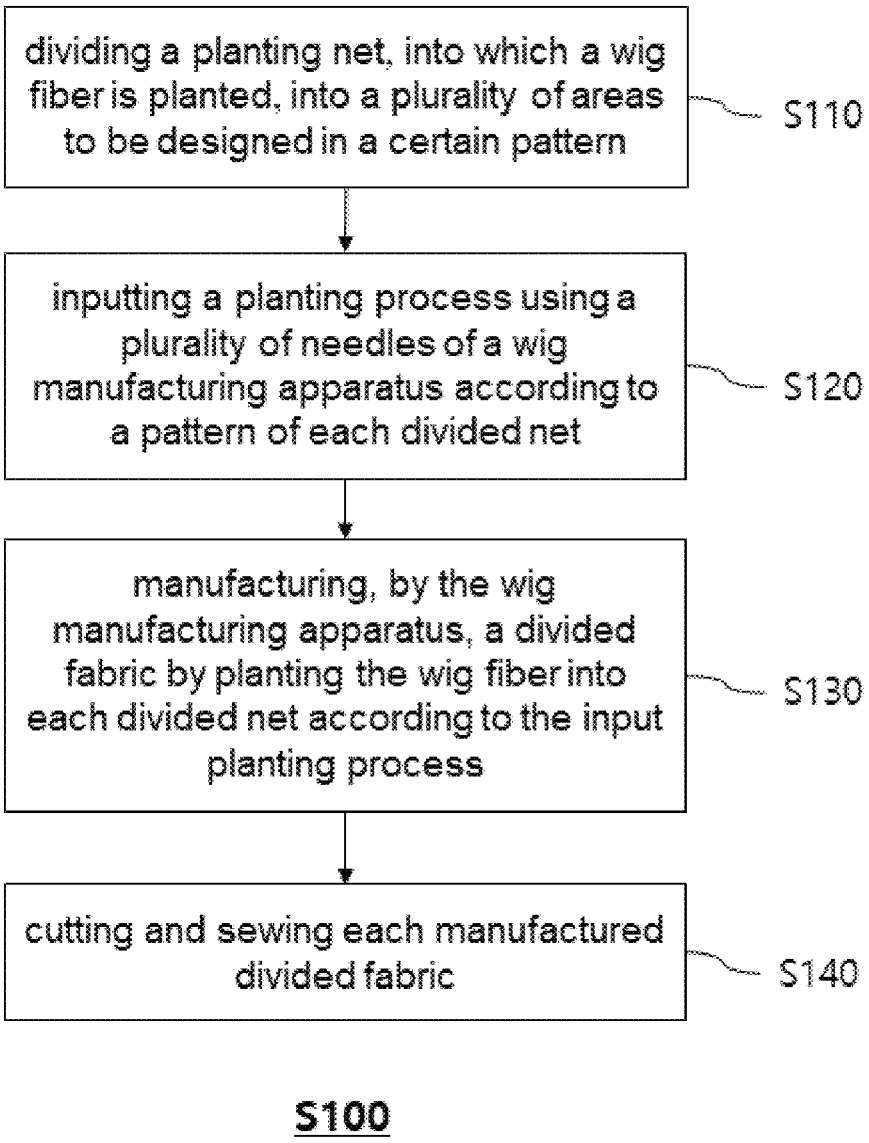
FIG. 9 is a flowchart illustrating a wig manufacturing method, according to an embodiment of the disclosure.

FIG. 9 is a flowchart illustrating a wig manufacturing method, according to an embodiment of the disclosure.

Referring to FIG. 9, a wig manufacturing method S100 according to an embodiment of the disclosure may include an operation S110 of dividing a planting net, into which a wig fiber is planted, into a plurality of areas to be designed in a certain pattern, by using a computer device, an operation S120 of inputting a planting process using a plurality of needles of a wig manufacturing apparatus according to a pattern of each divided net, an operation S130 of manufacturing, by the wig manufacturing apparatus, a divided fabric by planting the wig fiber into each divided net according to the input planting process, and an operation S140 of cutting and sewing each manufactured divided fabric.

The operation S130 of manufacturing a divided fabric may include adjusting tension of the planting net supplied to the wig manufacturing apparatus to be maintained at a pre-determined value according to a type of the planting net.

Also, the operation S130 of manufacturing a divided fabric may include receiving, from a user, planting patterns corresponding to the plurality of divided areas, through a user interface unit. For example, the divided planting net may include a front portion having a half-moon shape, a central portion having a rectangular shape and extending adjacent to the center of the front portion, a left portion having a half-fan shape and adjacent to a lower left side of the front portion and a left side of the central portion, and a right portion having a half-fan shape and adjacent to a lower right side of the front portion and a right side of the central portion.

Hereinafter, a wig manufactured according to a wig manufacturing apparatus and method according to an embodiment of the disclosure will be described.

Figure 10:
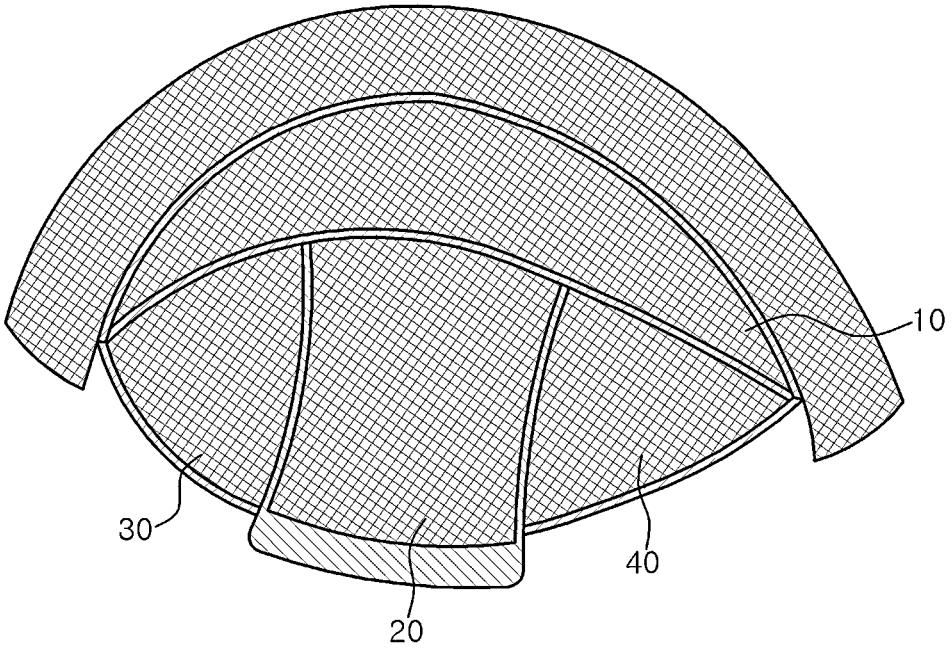
FIG. 10 is a view illustrating a sewn planting net used in a wig, according to an embodiment of the disclosure.

FIG. 10 is a view illustrating a sewn planting net used in a wig, according to an embodiment of the disclosure.

Referring to FIG. 10, a wig according to an embodiment of the disclosure may be designed by dividing a planting net into a front portion 10 having a substantially half-moon shape, a central portion 20 having a rectangular shape and extending adjacent to the center of the front portion 10, a left portion 30 having a half-fan shape and adjacent to a lower left side of the front portion 10 and a left side of the central portion 20, and a right portion 40 having a half-fan shape and adjacent to a lower right side of the front portion 10 and a right side of the central portion 20. For the wig, fabrics of the front portion 10, the central portion 20, the left portion 30, and the right portion 40 into which wig fibers are planted (or bound) may be manufactured by the wig manufacturing apparatus 100 and the manufactured divided fabrics of the front portion 10, the central portion 20, the left portion 30, and the right portion 40 may be sewn. A structure in which the fabrics of the front portion 10, the central portion 20, the left portion 30, and the right portion 40 are sewn and combined with each other may be a cap-type structure having a substantially hemispherical shape, and the fabrics of the left portion 30 and the right portion 40 may be symmetrical to each other.

The fabrics of the front portion 10, the central portion 20, the left portion 30, and the right portion 40 of the wig may be produced by inputting divided specifications of the fabrics of the front portion 10, the central portion 20, the left portion 30, and the right portion 40 to a computer of the automated wig manufacturing apparatus 100. For example, as the wig fibers planted into the fabrics of the front portion 10, the central portion 20, the left portion 30, and the right portion 40, fibers of various lengths may be planted according to a shape. Various styles in shapes of wigs may be achieved to create finished products that customers may use.

Figure 11:
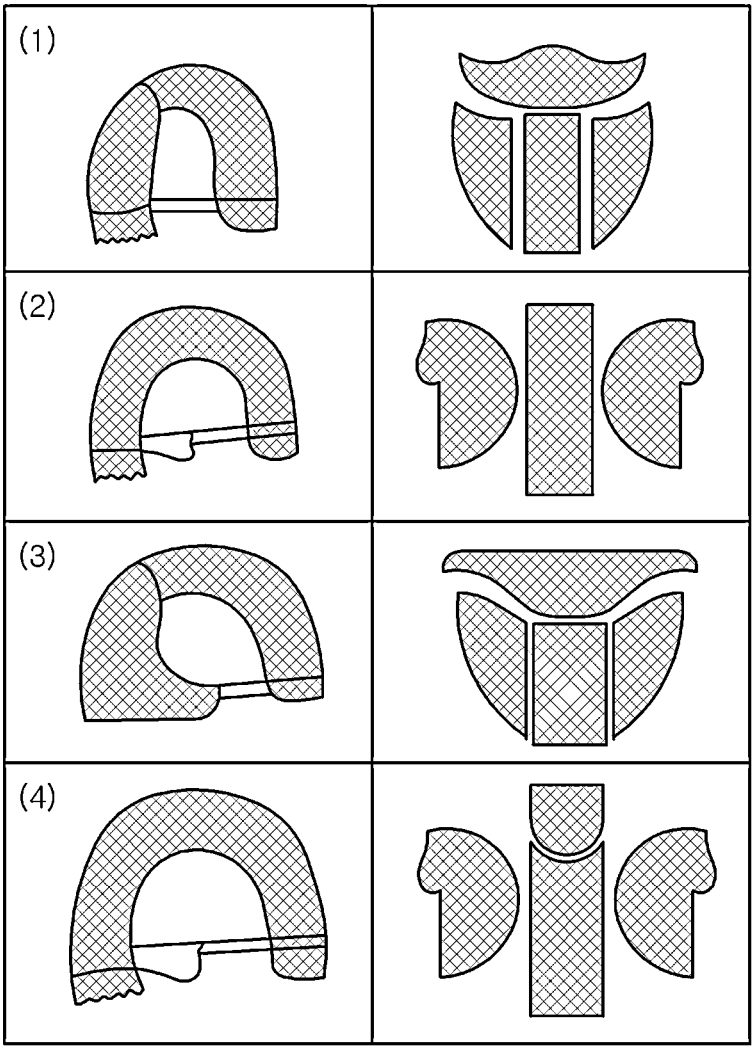
FIG. 11 is a side view illustrating a sewn planting net and a plan view illustrating a planting net before sewing, used in a finished wig, according to another embodiment of the disclosure.
Figure 12:
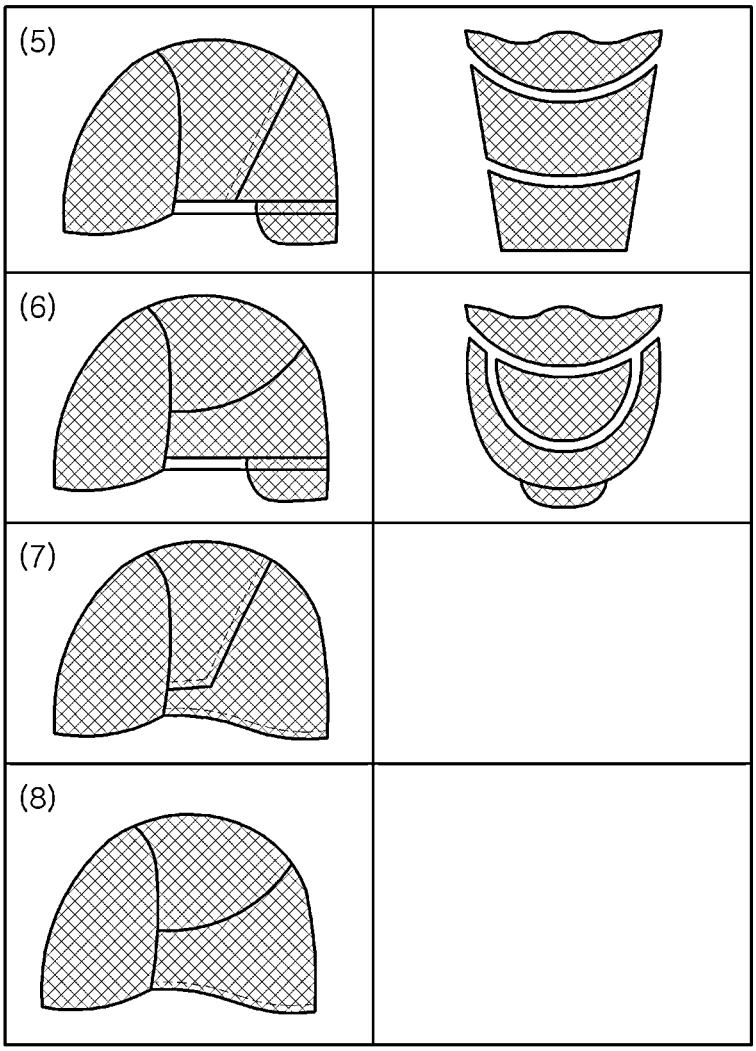
FIG. 12 is a side view illustrating a sewn planting net and a plan view illustrating a planting net before sewing, used in a finished wig, according to another embodiment of the disclosure.

FIG. 11 is a side view illustrating a sewn planting net and a plan view illustrating a planting net before sewing, used in a finished wig, according to another embodiment of the disclosure. FIG. 12 is a side view illustrating a sewn planting net and a plan view illustrating a planting net before sewing, used in a finished wig, according to another embodiment of the disclosure.

Referring to FIGS. 11 and 12, a sewn planting net used in a wig according to another embodiment of the disclosure is illustrated. The left side of each drawing is a side view illustrating a sewn planting net, and the right side of each drawing is a plan view illustrating a planting net before sewing. According to the present embodiment, as a planting net is designed by dividing a pattern shape of a front portion, a central portion, and a side portion of a wig into various shapes according to a user's head and style, divided patterns are efficiently placed on one planting net, and then wig fibers are simultaneously planted into the planting net through a wig manufacturing apparatus, wigs with various patterns may be efficiently mass-produced.

According to a wig manufacturing apparatus and method, and a wig using the same according to an embodiment of the disclosure, as a planting net is divided into a plurality of areas to be designed in a certain pattern, and wig fibers are planted according to the pattern of each divided net area, wig fabrics that are divided in various ways according to a user's head may be automatically manufactured and a cap-type wig may be produced by sewing the wig fabrics.

Also, as tension is adjusted to be constant when a planting net is supplied, a planting process may be efficiently performed, fiber loss may be prevented, and the quality of wig fabrics may be improved.

Effects of the disclosure are not limited to the above-mentioned effects, and other effects not mentioned herein will be clearly understood by one of ordinary skill in the art from the following description.

Although the disclosure has been described with reference to the embodiments illustrated in the drawings, it would be understood by one of ordinary skill in the art that various modifications and variations may be made therein. Accordingly, the scope of the disclosure should be defined by the following claims.

What is claimed is:

1. A wig manufacturing method comprising:

dividing a planting net, into which wig fibers are planted, into a plurality of areas, by using a computer device;

inputting a planting process using a plurality of needles of a wig manufacturing apparatus according to a pattern shape of each of the plurality of areas;

manufacturing, by the wig manufacturing apparatus, a divided fabric by planting the wig fibers into each of the plurality of areas according to the input planting process, wherein the manufacturing of the divided fabric comprises adjusting, by a tension adjusting device including a motor connected to a clamping unit, tension of the planting net supplied to the wig manufacturing apparatus to be maintained at a pre-determined value according to a type of the planting net, the clamping unit fixing one end of the planting net and the tension being adjusted by setting a speed of the motor through a user interface unit; and cutting each area of the plurality of areas with wig fibers secured thereto and sewing the plurality of areas together to form a wig.

2. The wig manufacturing method of claim 1, wherein the manufacturing of the divided fabric comprises selecting, by a user, planting patterns corresponding to the plurality of areas, through the user interface unit.

3. The wig manufacturing method of claim 1, wherein the divided planting net comprises a front portion having a half-moon shape, a central portion having a rectangular shape and extending adjacent to a center of the front portion, a left portion having a half-fan shape and adjacent to a lower left side of the front portion and a left side of the central portion, and a right portion having a half-fan shape and adjacent to a lower right side of the front portion and a right side of the central portion.

4. The wig manufacturing method of claim 3, wherein a shape obtained by sewing the front portion, the central portion, the left portion, and the right portion is a hemispherical shape, and the left portion and the right portion are symmetrical to each other.

* * * * *